US007346958B2

(12) United States Patent
Parsons

(10) Patent No.: US 7,346,958 B2
(45) Date of Patent: Mar. 25, 2008

(54) LEVERAGED BATON CAP

(75) Inventor: Kevin L. Parsons, Appleton, WI (US)

(73) Assignee: Armament Systems and Procedures, Inc., Appleton, WI (US)

( * ) Notice: Subject to any disclaimer, the term of this patent is extended or adjusted under 35 U.S.C. 154(b) by 0 days.

(21) Appl. No.: 10/684,970

(22) Filed: Oct. 14, 2003

(65) Prior Publication Data

US 2005/0076473 A1 Apr. 14, 2005

(51) Int. Cl.
*E05B 1/00* (2006.01)
*A63B 59/00* (2006.01)

(52) U.S. Cl. ..... 16/110.1; 463/47.2

(58) Field of Classification Search ..... 16/110.1, 16/441, 433, 417, 118, 121, 12, 30, 900, 18; 220/288; 231/6; D09/435; D21/100; 463/47.2
See application file for complete search history.

(56) References Cited

U.S. PATENT DOCUMENTS 83,228 A * 10/1868 Warne ..... 463/47.7
291,242 A * 1/1884 Tower ..... 463/47.2
786,040 A * 3/1905 Liberman et al. ..... 362/102
892,466 A * 7/1908 Sweeney ..... 220/288
1,084,969 A * 1/1914 Sargent ..... 16/110.1
1,496,949 A * 6/1924 Shaw ..... 220/288
2,099,447 A * 11/1937 Matsuyama ..... 463/47.4
2,266,606 A * 12/1941 Jones ..... 463/47.4
2,970,399 A * 2/1961 Frohlich et al. ..... 43/6
3,106,398 A * 10/1963 Gowdey ..... 463/47.2
3,148,406 A * 9/1964 Freiman ..... 16/441
D212,379 S * 10/1968 Dudas et al. ..... D7/393
D267,261 S * 12/1982 Pataluch ..... D21/679
4,383,387 A * 5/1983 Puskar ..... 446/236
4,522,398 A * 6/1985 Swartz et al. ..... 463/47.2
D284,553 S * 7/1986 Collister ..... D9/435
5,110,375 A 5/1992 Parsons
5,149,092 A 9/1992 Parsons
5,188,362 A * 2/1993 Ashihara ..... 463/47.6
5,348,297 A 9/1994 Parsons
D351,878 S * 10/1994 Globus ..... D21/679

(Continued)

OTHER PUBLICATIONS

One (1) page (not dated) www. DTNUIB.com advertisement re DTNUB—Stinger / DTNUB = ASPL. Applicant submits that he was aware of the products shown more than one year prior to the filing of the above-identified patent application.

(Continued)

*Primary Examiner*—Robert J. Sandy
(74) *Attorney, Agent, or Firm*—Welsh & Katz, Ltd.

(57) ABSTRACT

A leveraged end cap, which can be removably placed onto existing batons, permits a user to grasp a baton at a lower position along the baton. The leveraged end cap defines a location that can be grasped using the little finger, or pinky, of the hand such that the baton is pivoted about the little finger providing an additional length of lever arm equivalent to about one hand length. The baton held in this manner is locked into place until released, such that slippage or accidental dropping of the baton are minimized. The increased lever arm created by the use of the leveraged end cap allows the user to generate a strike force in the baton equivalent to a longer length baton, permitting the user to adopt a smaller, more easily concealable and lighter weight baton.

4 Claims, 1 Drawing Sheet

U.S. PATENT DOCUMENTS

| | | | | | |
|---|---|---|---|---|---|
| 5,356,139 | A | | 10/1994 | Parsons | |
| 5,363,285 | A | * | 11/1994 | Wideman | 362/102 |
| 5,454,565 | A | * | 10/1995 | Ramirez | 463/47.2 |
| 5,645,276 | A | | 7/1997 | Parsons | |
| 5,728,003 | A | | 3/1998 | Hustad | |
| 5,919,093 | A | | 7/1999 | Parsons | |
| 6,135,888 | A | | 10/2000 | Hindi | |
| 6,196,921 | B1 | * | 3/2001 | Larson | 463/47.2 |
| 6,261,188 | B1 | * | 7/2001 | Badura | 463/47.2 |
| D476,568 | S | * | 7/2003 | Mechtold et al. | D9/454 |
| D503,886 | S | * | 4/2005 | Biesecker | D9/435 |

OTHER PUBLICATIONS

One (1) page (not dated) www.DTNIUB.com advertisement re "Less Lethal Force Option That Work!" Applicant submits that he was aware of the products shown more than one year prior to the filing of the above-identified patent application.

Eight (8) pages from http://dtnub.com re Patented Police Products and DTNUB Training dated Feb. 27, 2001 and Mar. 1, 2001. Applicant submits that he was aware of the products shown more than one year prior to the filing of the above-identified patent application.

* cited by examiner 34
26c
26b
26
P
40
26d
10
20
10a
43
40
FO 2
22
P
26a
20
42
44
28
30
24
35
26c
27
26b
26a
26
25
32
36
40
38

LEVERAGED BATON CAP

FIELD OF THE INVENTION

The present invention concerns batons for use by police or security personnel. More particularly the present invention concerns an end cap for use in a baton. The end cap provides a better grip and increased leverage by lowering the pivot point, thus increasing the effective swing arm. Thus, a smaller, more easily portable baton with the present end cap can emulate the effective swing of a larger baton.

BACKGROUND OF THE INVENTION

Batons, as used by security forces, police officers and other law enforcement personnel, are typically steel hollow-core retractable devices, such as the baton shown in U.S. Pat. Nos. 5,110,375, 5,149,092, 5,348,297, 5,356,139, 5,645,276, 5,919,093 and others, assigned to Armament Systems and Procedures, Inc., the assignee of the present invention. These batons are constructed such that one segment of the baton is retractable within the next adjacent segment until all of the segments are retracted into an outer segment, for storage. These batons are extremely popular among law enforcement and security personnel, as over two million such batons have been reported to have been sold. Further, the popularity of these batons can be understood because such batons, as made by the assignee, are well made, sturdy, extremely reliable, and compact, and are easily used, stored and carried. Batons having expandable lengths of 21 inches and 26 inches are among the most popular batons with law enforcement and security personnel.

As law enforcement and security personnel have come to carry more numerous pieces of equipment, such as batons, telephones, handcuffs, walkie-talkies, pepper spray devices, disposable restraints, semi-automatic pistols, extra magazines and the like, which assist them in maintaining the peace, it has become desirable to reduce the size and weight of such devices, and in particular, batons. Further, in some situations, such as those faced by undercover officers and/or protective agents (such as U.S. Secret Service Agents), such equipment must be made smaller so that they can be concealed.

One item that can be purchased in various sizes (lengths) is the baton. It has been found that a smaller baton, for example, batons having expandable lengths of 16 inches or 21 inches, are more convenient to carry than full sized batons, such as 26 and 31 inch expandable batons. While it is easier to carry such smaller batons, they typically do not have the same impact potential of a larger baton. That is, because they form a smaller lever arm when swung, they require a more vigorous swing to produce an effective strike.

In the use of such batons, typically the user holds the baton squarely by the outer most segment, or the handle, and using a quick wrist action causes the baton to extend to its full length. The baton is then swung as needed while the user holds the outer tubular section or handle. Typically, the baton is held with the hand centered on the "grip" portion, and the little, or "pinky" finger nearer the proximal end of the baton, and the thumb and forefinger nearer the distal end of the baton. In operation, the user may hold the baton at or near the center of the outer segment.

When swinging a baton, it may slip forward to some degree in the user's hand. To address this problem, U.S. Pat. No. 5,919,093 (noted above) provides a formed grip for a baton that gives an excellent handhold on the baton. Some manufactures have provided less effective means of providing a friction hold. However, even with such textured handles, the user must still grasp the baton nearer to the center of the outer segment to insure a proper grip so that if the baton slips in the user's hand, it will not completely slip out of the hand. As a result, a substantial portion of the lower segment of batons is often unused during the swing, thus under-utilizing the full lever arm potential of the baton. While this is not a serious problem with longer batons, the loss of the lever arm becomes more tangible with smaller batons. The "lost length" can be equated with a reduction in the moment arm in a lever, and further equates to a substantial loss of force when the baton is swung.

It is therefore desirable to have a baton that can be grasped closer to or at its proximal end to provide the user with greater strike force without the baton slipping relative to the user's hand. It is also desirable to have a baton which when grasped provides a point of pivot at or about the little, or "pinky", finger, instead of at or near the point of placement of the thumb and forefinger, such that a greater strike impact can be imparted with a smaller baton.

SUMMARY OF THE INVENTION

In accordance with the present invention, a leveraged baton cap, comprising an end knob, a tapered neck portion, and means for attachment to a baton are provided to allow the user to grasp a baton at its most proximal end point. In a preferred embodiment, the end knob of the leveraged baton cap is generally hemispheric in shape, the proximal end being rounded, the distal end being formed into a generally hyperbolic, or hour glass, shaped neck joining a connection segment for attachment to a baton. In a preferred embodiment, the end knob and generally hyperbolic neck are attached to a baton with a generally cylindrical connection segment having internal threadings that cooperatively engage a typical baton having an externally threaded proximal end segment.

In a preferred embodiment, the generally hemispheric knob comprises a proximal end and a distal end, the proximal end may be somewhat flattened. In another embodiment, the hemispheric knob is detachable such that knob ends having different shapes, or ends having means to attach an emblem or medallion, can be attached to the leveraged end cap. In a further embodiment, a one piece leveraged end cap is provided defining means to receive a medallion, seal or other decorative element.

Advantageously, the baton cap is made such that it can be sold independently of the baton and is easily and removably attached to a baton, such as by the use of cooperative threads matching those on most commercially available batons. In this manner, baton owners need not purchase new batons to take advantage of the useful and novel improvements of the present invention. Purchase of the baton cap can be made in locations that sell police and security personnel accessories such that end caps can be easily located and quickly assembled onto the baton.

In the use of the baton cap of the present invention, the user attaches the baton cap to a baton and places his hand at the base of the baton such that his little, or "pinky" finger is wrapped about the neck of end cap such that a better grip on the baton grip position is achieved, which grip position is advantageously located at a lower position on the baton, i.e. closer to the end cap. The wrapping of the finger about the baton cap permits the user to properly position the baton for use and to lock the baton in position for use without fear of slippage, as will be explained below. Further, the baton held in this manner can now pivot about the position of the little finger, due to the smaller diameter of the baton cap creating a pivot point, giving an increased lever arm. The length of the lever arm in this position not only includes the length of the grip portion of the baton, but also includes the length of the grip portion covered by almost the entire length of the user's hand as well. Further, the positioning of the hand in this manner, along with the extension of the hemispherical portion of the end cap beyond the location of the hand on the baton, provides hand protection against inadvertently striking of an object through the end of the swing. The user can then use the baton in the usual manner with the added advantage of action found in longer batons.

The features of the present invention which are believed to be novel are set forth with particularity in the appended claims. The invention, together with further objects and advantages thereof, may best be understood by reference to the following description in conjunction with the accompanying drawings.

DETAILED DESCRIPTION OF THE INVENTION

Figures 1, 2, 3, 4:
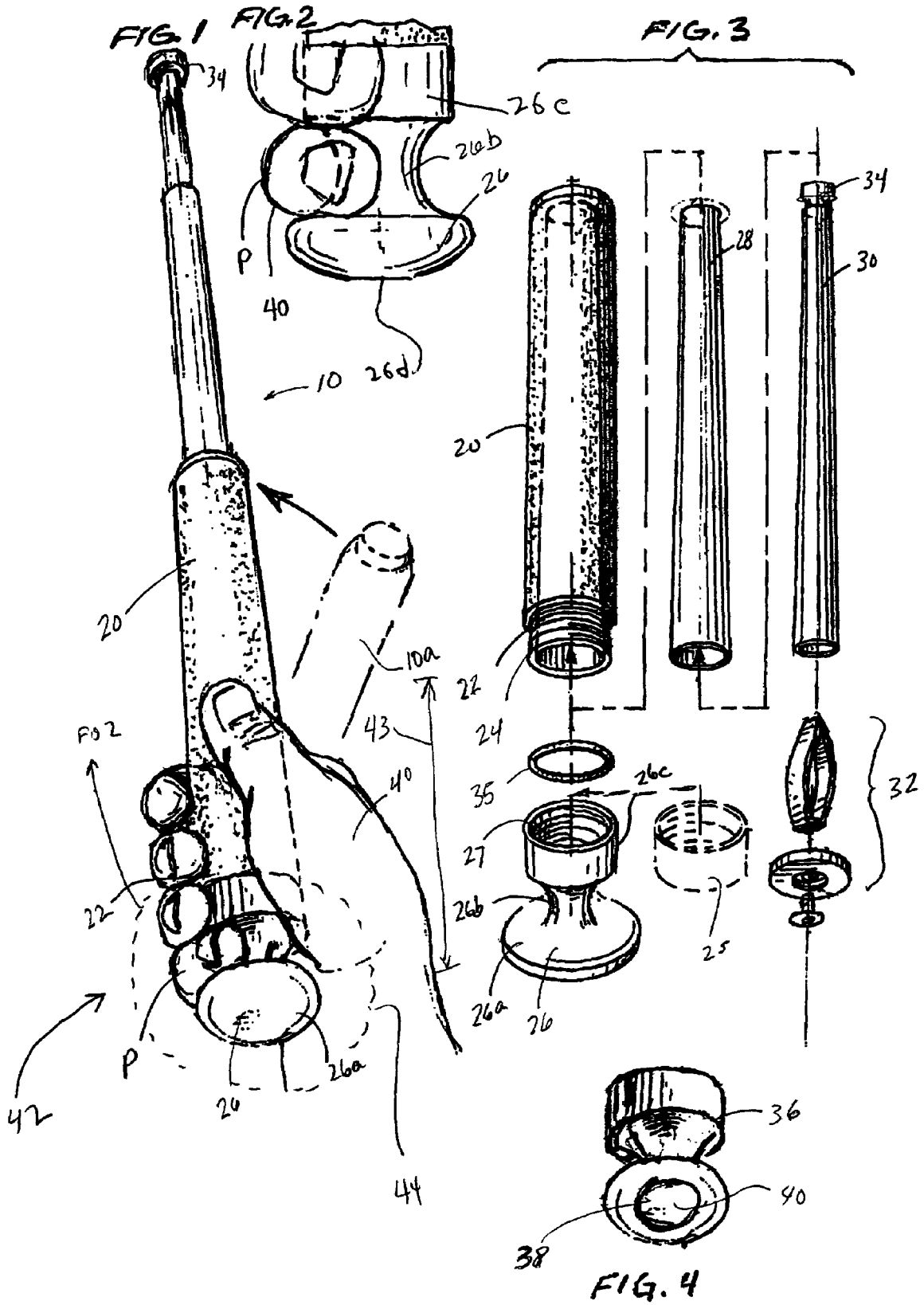
FIG. 1 is a perspective view of a fully open baton incorporating the leverage cap of the present invention, showing a first retracted position in phantom lines.
FIG. 2 is an enlarged perspective view of the leverage cap of the area shown in FIG. 1, showing gripping of the baton by the last two fingers of the user's hand.
FIG. 3 is an exploded perspective view of a baton showing the leverage cap of the present invention and a typical known end cap shown in phantom view.
FIG. 4 is a perspective view of another embodiment of the leverage cap of the present invention.

While the present invention is susceptible of embodiment in various forms, there is shown in the drawings a number of presently preferred embodiments that are discussed in greater detail hereafter. It should be understood that the present disclosure is to be considered as an exemplification of the present invention, and is not intended to limit the invention to the specific embodiments illustrated.

Referring to the drawings, FIG. 1 shows a typical baton 10, which may be similar to a number of batons made by Armament Systems and Procedures, Inc., assignee of the present invention, which batons are described in U.S. Pat. Nos. 5,110,375, 5,149,092, 5,348,297, 5,356,139, 5,645,276 and 5,919,093, and are incorporated herein by reference in their entirety. As shown in FIG. 3, the baton 10 may include three segments, namely an outer segment 20, a middle segment 28, and a third or end segment 30. The outer segment 20 has a proximal end 22 having external threads 24 for receiving a leveraged end cap 26 of the present invention. The leveraged end cap 26 replaces the known end cap 25, which is a standard component of commercially available batons.

The baton 10 further comprises a tip 34, which is preferably removable, and segment locking means 32. Each of these elements are known and described in detail in the U.S. patents noted above. A gasket 35 is provided to permit a sealing and well-seated relationship between the baton 10 and the leverage end cap 26 of the present invention. FIG. 3 shows assembly of a baton 10 components including details regarding replacement of the known end cap 25 with the leveraged end cap 26 of the present invention. Details of the assembly of baton 10 can be found in the above-cited U.S. patents.

Referring back to FIG. 1, a baton 10 is shown in a first or retracted position 10*a* in phantom lines, and in a second or extended position in solid lines. A leverage end cap 26 is attached to the baton 10 by rotatably connecting the internal threads 27 of the end cap to the external threads 24 of the baton.

Referring now to FIGS. 1-3, the end cap 26 includes a knob portion 26*a*, a neck portion 26*b* and a connection segment 26*c*. The knob portion 26*a* is generally rounded to provide a comfortable end segment to the baton 10 when gripped by the user. In this way, the user is provided with a smooth end, which is less likely to cause pain or injury if the user accidentally collides therewith. It will be understood that various shapes of the knob 26*a* can be adopted without departing from the novel scope of the present invention. In the embodiment shown in FIG. 2, the knob 26*a* may include flattened surface 26*d*. In a further embodiment, shown in FIG. 4, end cap 36 includes means, such as cut-out or indentation 38, into which a medallion or seal 40 can be placed for decorative purposes.

Knob 26*a* permits a user's hand 40 to grasp the baton at a location more proximal or lower down along the baton 10 than is possible with batons not utilizing a leverage end cap 26. As shown in FIG. 2, the little finger, or pinky, P of the user is placed such that it rests within the double concave or "hour-glass" shaped neck.

Preferably, the end cap 26 can be made of the same or similar materials as the baton 10 and/or known cap 25. Alternatively, it can be formed from other metals, plastics or other materials without departing from the novel scope of the present invention. Further, end cap 26 can be made in a color to match the baton 10, or can have any color suited to match either uniforms or a preferred color scheme without departing from the novel scope of the present invention.

Initially, a commercially-available baton is obtained. Next, the standard or known end cap 25 is removed by rotating it such that the threads of the baton disengage from the threads of the end cap. The leveraged end cap 26 is then secured to the end of the baton by rotating it to engage the threads. It will be understood that a user may remove leveraged end cap 26 from baton 10 when desired by easily unscrewing cap 26 and, if desired, replacing cap 25.

In operation, the user, after attaching the leveraged end cap 26, can grasp the baton at a lower position 42 on the outer segment 20, such that a greater lever arm is created, thus enhancing striking power. The user places his little finger, or pinky, P within the hour-glass shaped neck portion 26*b* such that a positive grip is established. In this hand position, the user establishes a striking power similar to a longer baton, while maintaining control and having the desirable convenience of using a smaller baton.

In this position, the baton 10 pivots at the location of the little finger P providing f the baton, thus increasing the lever arm of the baton by a length approximately one "hand-width." Further, as the baton 10 is held such that its proximal end 22 is wrist 44 of the user 40, a quicker whip like action can be made with the baton, ing power similar to that of a longer baton.

Although an illustrative embodiment of the invention has been shown and to be understood that various modifications and substitutions may be made by n the art without departing from the novel spirit and scope of the invention.

What is claimed is:

1. A method of increasing the leverage impact force obtainable with a baton having an elongated hand-graspable generally cylindrical handle defining the longitudinal axis of the baton and having a proximal end and a distal end, said method including the steps of:

providing a leverage end cap having a unitary body defining an enlarged proximal end knob, a generally hour-glass shaped annular groove contiguous to said end knob and having a minor diameter substantially smaller than the end knob, and a generally cylindrical distal end contiguous to said groove and having an external diameter substantially the same as the diameter of the baton handle and greater than the minor diameter of said groove, said distal end defining means for releasable attachment to the proximal end of the baton handle;

attaching the leverage end cap to the proximal end of the baton so that the end cap is generally axially aligned with the baton;

grasping the baton such that the little, or pinky, finger of the user's baton-holding hand is received in and wraps about the annular groove of the leveraged baton cap such that the end knob abuts the hand adjacent the little finger with at least one of the remaining fingers of the hand wrapped about the baton on or adjacent the end cap; and maintaining said grasp throughout use of the baton.

2. The method of claim 1, including the step of providing cooperative threadings within the leverage end cap and on the proximal end of the baton such that the baton and end cap can be releasably and rotatably connected.

3. A method for increasing the leverage force obtainable with an elongated baton having a generally cylindrical handle defining a longitudinal axis and opposite proximal and distal ends with the proximal end enabling gripping in the palm of a user's hand, said method comprising:

providing a leverage end cap having a unitary body defining a longitudinal axis and having a first end of a transverse cross section of substantially similar size to the transverse cross section of the proximal end of the baton handle, said first end including means for releasably securing it to the proximal end of the baton in substantially axially aligned relation therewith, said leverage cap having an opposite second end defined by an enlarged knob having a greater peripheral size than said first end, said cap having a circumferential groove of generally U-shaped concave profile between and contiguous to said first end and said knob end and having a minor transverse cross-sectional area substantially less than the cross-sectional area of said first end, securing the first end of the leverage end cap to the proximal end of the baton, and gripping the leverage end cap with one's hand such that the little finger of the hand is received within the circumferential groove and at least partially wraps the groove so that the knob engages the surface of the hand adjacent the little finger and prevents slippage of the hand in the direction of the knob and at least the first finger of the user's hand encircles the proximal end of the baton handle whereby to create an extended lever fulcrum at the little finger when manipulating the baton to impact an object.

4. The method as defined in claim 3 wherein the step of securing the first end of the leverage cap to the proximal end of the baton includes connecting said first end of the cap to the baton by a threaded connection.

* * * * *